US009388810B2

(12) United States Patent
Crotti et al.

(10) Patent No.: US 9,388,810 B2
(45) Date of Patent: Jul. 12, 2016

(54) ROTARY VACUUM PUMP WITH CIRCUMFERENTIAL GROOVE FOR A LUBRICATING AND SEALING FLUID

(71) Applicant: VHIT S.P.A., Offanengo (CR) (IT)

(72) Inventors: Antonio Crotti, Offanengo (CR) (IT); Luciano Marchetti, Offanengo (CR) (IT); Fabio Martello, Offanengo (CR) (IT); Johannes Muellers, Offanengo (CR) (IT)

(73) Assignee: VHIT S.P.A., Offanengo (IT)

( * ) Notice: Subject to any disclaimer, the term of this patent is extended or adjusted under 35 U.S.C. 154(b) by 0 days.

(21) Appl. No.: 14/351,002

(22) PCT Filed: Oct. 10, 2012

(86) PCT No.: PCT/IB2012/055467
§ 371 (c)(1),
(2) Date: Apr. 10, 2014

(87) PCT Pub. No.: WO2013/054263
PCT Pub. Date: Apr. 18, 2013

(65) Prior Publication Data

US 2014/0341767 A1 Nov. 20, 2014

(30) Foreign Application Priority Data

Oct. 13, 2011 (IT) ..... TO2011A0912

(51) Int. Cl.

| | |
|---|---|
| ***F04C 29/02*** | (2006.01) |
| ***F04C 25/02*** | (2006.01) |
| ***F04C 18/344*** | (2006.01) |
| ***F04C 27/00*** | (2006.01) |

(52) U.S. Cl.
CPC ..... *F04C 29/02* (2013.01); *F04C 25/02* (2013.01); *F04C 27/009* (2013.01); *F04C 18/344* (2013.01); *F04C 2240/30* (2013.01); *F04C 2240/54* (2013.01)

(58) Field of Classification Search
CPC ..... F04C 18/344; F04C 2240/30; F04C 2240/54; F04C 29/02
See application file for complete search history.

(56) References Cited

U.S. PATENT DOCUMENTS

| | | | | |
|---|---|---|---|---|
| 2,672,282 | A | 3/1954 | Vazguez | |
| 3,453,031 | A * | 7/1969 | Bjork et al. | 384/118 |
| 3,814,554 | A * | 6/1974 | Jansson et al. | 418/73 |
| 3,961,870 | A * | 6/1976 | Vlemmings | 418/73 |
| 4,038,000 | A | 7/1977 | Dworak | |
| 4,930,907 | A * | 6/1990 | Smith | 384/118 |

(Continued)

FOREIGN PATENT DOCUMENTS

| | | |
|---|---|---|
| DE | 1 528 963 A1 | 9/1970 |
| DE | 24 21 599 A1 | 11/1975 |

(Continued)

*Primary Examiner* — Mary A Davis
(74) *Attorney, Agent, or Firm* — Sughrue Mion, PLLC

(57) ABSTRACT

A rotary vacuum pump, for instance a vane pump, has at least one circumferential groove (6) between facing side surfaces of the rotor (2) and of the rotor guide (3) for receiving a lubricating and sealing fluid. The circumferential groove (6) is a partial annular groove, which has an angular extension of less than 360° and has at least one interruption enabling creating a hydrodynamic fluid bearing in a region opposite a discharge region of the pump (1; 101; 121; 201), over the whole axial extension of the facing surfaces. A method of lubricating a rotary vacuum pump is also provided.

19 Claims, 4 Drawing Sheets

(56) References Cited

U.S. PATENT DOCUMENTS

| | | | | |
|---|---|---|---|---|
| 4,989,997 | A * | 2/1991 | Yoshimura | 384/100 |
| 5,545,014 | A * | 8/1996 | Sundberg | F04C 2/3441 418/268 |
| 5,743,654 | A * | 4/1998 | Ide et al. | 384/100 |
| 8,308,464 | B2 * | 11/2012 | Yoshimura | 418/73 |
| 2011/0027118 | A1 * | 2/2011 | Milovanovic | 418/206.5 |
| 2012/0114514 | A1 * | 5/2012 | Laetzel et al. | 418/201.1 |

FOREIGN PATENT DOCUMENTS

| | | | | |
|---|---|---|---|---|
| GB | 966 841 | A | 8/1964 | |
| GB | 1 055 850 | A | 1/1967 | |
| WO | 96/33338 | A1 | 10/1996 | |
| WO | 2009/046810 | A1 | 4/2009 | |
| WO | WO 2009046810 | A1 * | 4/2009 | F04C 18/344 |
| WO | WO 2010102722 | A2 * | 9/2010 | |

* cited by examiner

ROTARY VACUUM PUMP WITH CIRCUMFERENTIAL GROOVE FOR A LUBRICATING AND SEALING FLUID

CROSS REFERENCE TO RELATED APPLICATIONS

This application is a National Stage of International Application No. PCT/IB2012/055467 filed Oct. 10, 2012, claiming priority based on Italian Patent Application No. TO2011A000912 filed Oct. 13, 2011, the contents of all of which are incorporated herein by reference in their entirety.

TECHNICAL FIELD

The present invention relates to a rotary vacuum pump and to a method of lubricating such a pump.

Preferably, but not exclusively, the present invention is applied in the automotive field, in particular for intaking air from the brake booster.

PRIOR ART

Vacuum pumps commonly used in brake boosters of motor vehicles are rotary pumps having a rotor with one or more vanes which, during the rotation of the rotor, give rise to chambers with variable volume. The rotor is made to rotate about an axis, e.g. by the shaft of the vehicle engine, by means of a suitable drive joint, and is housed in a rotor seat or guide that, in most cases, is lubricated, typically with engine oil supplied through a supply channel. Lubrication is aimed at preventing wear of the pump and at creating a seal between the inside and the outside of the pump. Generally, one or more axial grooves are also provided on the rotor guide, in order to improve the transportation of the lubricant towards the pump inside in order to lubricate the components within the pump.

Air from outside the pump (typically at atmospheric pressure) can leak towards the inside of the pump (under negative pressure) through the clearance between the rotor and the guide. Such an air leak towards the inside of the pump increases the power absorbed by the pump and lowers its performance.

In order to reduce such a leak, it has already been proposed to provide an annular groove, filled with lubricant, between the rotor guide and the rotor. The groove may be formed on the rotor guide surface or on the rotor surface or may be defined by steps of such surfaces, and it extends over the whole circumference of the concerned surface(s). Examples of pumps with such an annular groove are disclosed in WO 2009/046810 and FR 2640699. The annular groove improves sealing by providing an oil barrier between the inside and the outside of the pump, thereby preventing air from entering again the pump through the rotor—rotor guide clearances. Yet, such an arrangement gives rise to a problem.

Pressures inside the pump chamber vary with time and are different in the different chambers. Such pressure differences generate forces that radially push the rotor against the guide. Such forces are balanced by the pressure originating in the hydrodynamic bearing provided by the oil between the rotor, which is rotating, and the guide. The provision of an annular groove extending over 360° reduces the area in which the rotor is in contact with the rotor guide and breaks the hydrodynamic bearing in the region of the annular guide and in adjacent areas, thereby reducing the balancing effect on the forces inside the pump. This causes a worsening of the wear with respect to the conventional configurations without annular groove, especially in the mutually contacting areas of the rotor and the guide.

The higher wear, during the pump operating life, produces greater guide-rotor clearances, which in turn cause:

- worsening of the sealing provided by the groove, with a consequent increase of the power absorbed by the pump and a lowering of the pump performance;
- increase in oil absorption by the pump.

It is the object of the invention to provide a vacuum pump and a method of lubricating same that obviate the drawbacks of the prior art.

DESCRIPTION OF THE INVENTION

According to the invention, this is achieved in that the pump includes at least one partial annular groove (or circumferential groove), which has an angular extension of less than 360° and has at least one interruption arranged to enable creating a hydrodynamic fluid bearing in a region opposite a discharge region of the pump, over a whole axial extension of facing side surfaces of the rotor and the rotor guide.

Advantageously, the at least one circumferential groove has an extension ranging from 150° to 300° and preferably from 180° to 220°.

The at least one circumferential groove may be arranged orthogonally to the rotation axis of the rotor or it may be inclined with respect to said axis. The second solution improves axial lubrication.

The at least one circumferential groove may be formed in the side surface of the rotor or of the guide or it may be defined by steps of said side surfaces. In case of a groove formed in the surface of a vane rotor, the or each groove consists of at least one pair of arcs separated by an equal number of interruptions. In particular, an arc and an interruption are provided for each discharge phase at each revolution of the pump rotor, the arcs and the interruptions being arranged so that, during the discharge phases, the interruptions between the arcs pass in the region opposite the discharge region.

In a second aspect of the invention, a method of lubricating a rotary vacuum pump comprises forming, between facing side surfaces of the rotor and of the rotor guide, at least one circumferential sealing barrier, which has an angular extension of less than 360° and has at least one interruption arranged to enable creating a hydrodynamic fluid bearing in a region opposite the discharge region of the pump, over the whole axial extension of said side surfaces.

BRIEF DESCRIPTION OF THE FIGURES

Further features and advantages of the invention will become apparent from the following description of preferred embodiments, given by way of non limiting example with reference to the accompanying drawings, in which.

DESCRIPTION OF PREFERRED EMBODIMENTS

Figure 1:
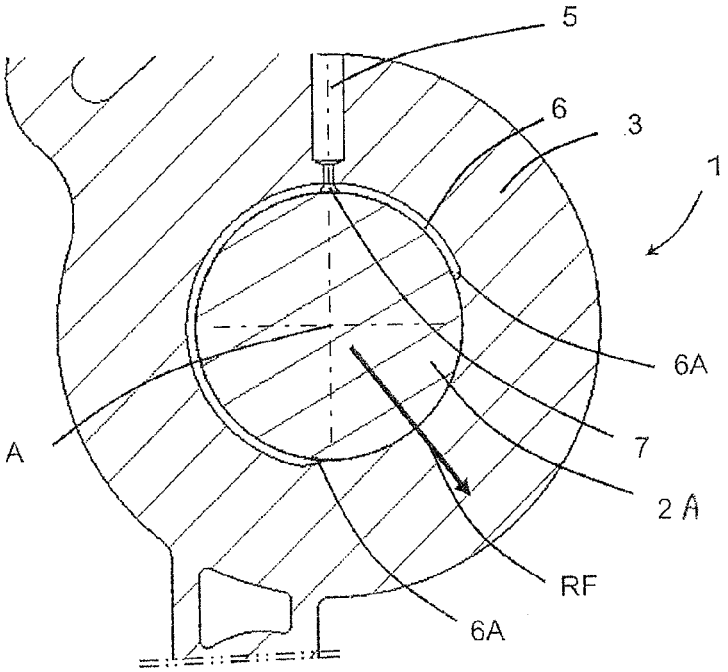
FIG. 1 is a sectional view, orthogonal to the rotor axis, of a vacuum pump incorporating the invention, in a first embodiment in which the circumferential groove is formed on the rotor guide.
Figure 2:
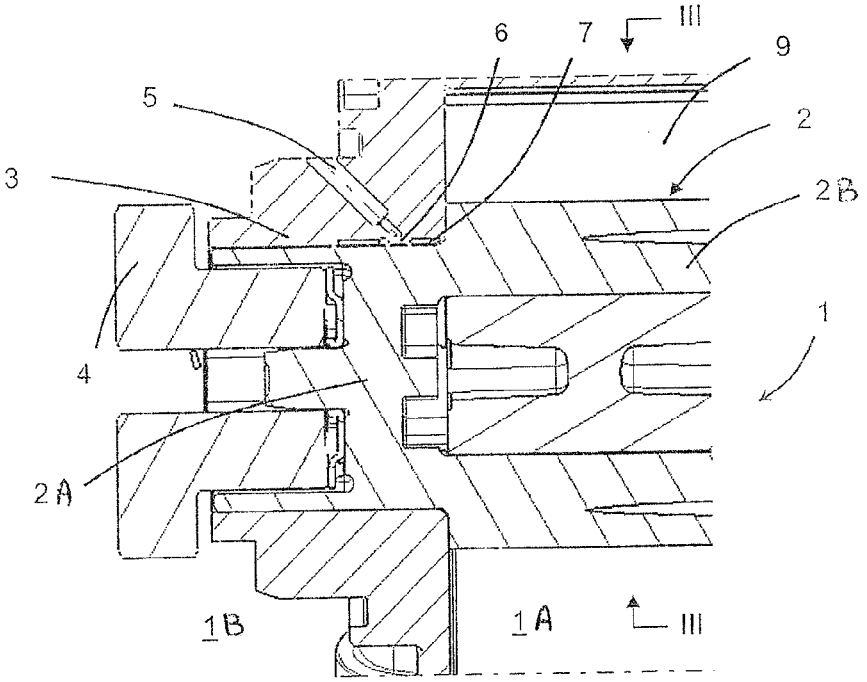
FIG. 2 is an axial section of the pump shown in FIG. 1.
Figure 3:
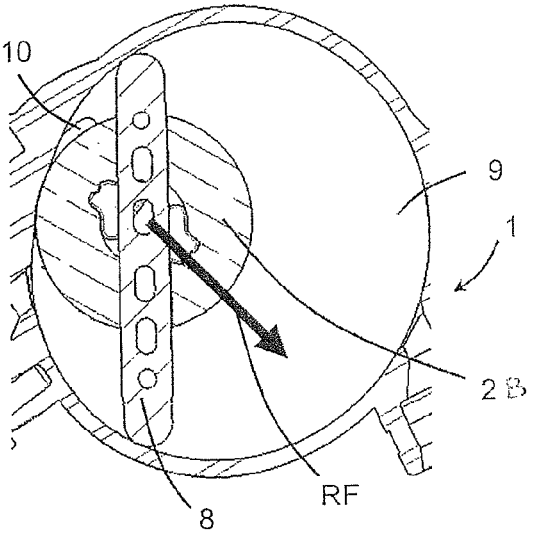
FIG. 3 is a schematic sectional view, orthogonal to the rotor axis and taken along a plane passing through line III-III in FIG. 2.

Referring to FIGS. 1 to 3, a vacuum pump 1 comprises a rotor 2, for instance a rotor with a single vane 8. An end portion 2A (support portion) of the rotor is concentrically mounted in a guide 3 formed in the pump body. The opposite portion 2B, in which vane 8 is arranged, eccentrically rotates in a chamber 9 in which an intake duct (not shown) and a discharge duct 10 open. A driving joint 4, transmitting the rotation of a drive shaft (for instance the shaft of a vehicle engine) to rotor 2, is fastened to portion 2A. Reference symbol A denotes the axis of rotation of rotor 2.

Such a pump structure and its general operation are wholly conventional and they do not need a more detailed description.

Guide 3 has formed therein a supply channel 5 for a lubricant, typically the engine oil, intended also to create a seal between the inside 1A and the outside 1B of the pump. Channel 5 ends into a circumferential groove 6 that, in such an embodiment, is formed in guide 3 and lies in a plane perpendicular to the axis of rotor 2. Contrary to the prior art, according to the invention groove 6 does not extend over the whole circumference of guide 3, but only over an arc extending between the two points 6A. There is therefore a region of guide 3 where groove 6 is interrupted.

Groove 6 is to be interrupted where it is necessary or important to provide the hydrodynamic bearing opposing the pressures arising during the discharge phases of the pump (two at each revolution, in the case of the rotor shown in FIG. 3). As stated before, such pressures apply to rotor 2 forces, the resultant of which is shown by arrow RF FIGS. 1 and 3, which push the rotor against guide 3 in the region opposite discharge duct 10. This is the angular region where the hydrodynamic bearing has to be maintained. Such a region has an extension varying depending on the application and indicatively ranging from 60° to 180°.

The extension of groove 6 will be therefore a trade off between the two opposite requirements of not excessively interfering with the formation of the hydrodynamic bearing, and of still having an effective barrier against air leak from the outside. Tests performed by the Applicant have shown that a satisfactory trade off is obtained with an angular extension of groove 6 ranging from about 150° to about 300°. Values at present considered as preferable are in range of about 180° to 220°.

Once the requirement of having the hydrodynamic bearing in the region opposite discharge duct 10 has been met, there are no particular constraints about the position of groove 6. By way of example, FIG. 1 shows an asymmetrical groove 6, one branch of which extends as far as to a point diametrically opposite the end of channel 5. In the alternative, however, groove 6 could symmetrically extend at both sides of channel 5: such a solution would allow a better pressure distribution between both groove branches.

Groove 6 can have any cross-sectional shape (rectangular, trapezoidal, arc of circumference, etc.).

An axial groove 7, extending from circumferential groove 6 towards the inside of the pump or, preferably, extending at both sides of circumferential groove 6, as shown in FIG. 2, is provided at the outlet of channel 5 into circumferential groove 6. Multiple axial grooves 7, distributed along circumferential groove 6, could also be provided.

The invention solves the problems mentioned above. Indeed, since the circumferential groove does not extend over the whole circumference of the rotor and/or of the guide, an increase of the useful contact area between the rotor and the guide occurs, and the negative phenomenon of the break of the hydrodynamic bearing is avoided. In turn, this entails:

- a reduction of the wear at the end of the operating life of the rotor guide and the rotor;
- a better stability of the pump performance between the beginning and the end of the operating life; and
- a better stability of the oil flow absorbed by the pump between the beginning and the end of the operating life.

Figure 4:
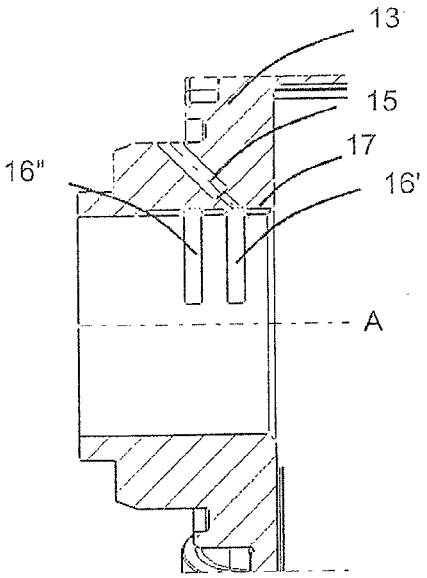
FIGS. 4 and 5 are sectional views of the rotor guide, orthogonal to the rotor axis and showing two variants in which several circumferential grooves are provided on the rotor guide.
Figure 5:
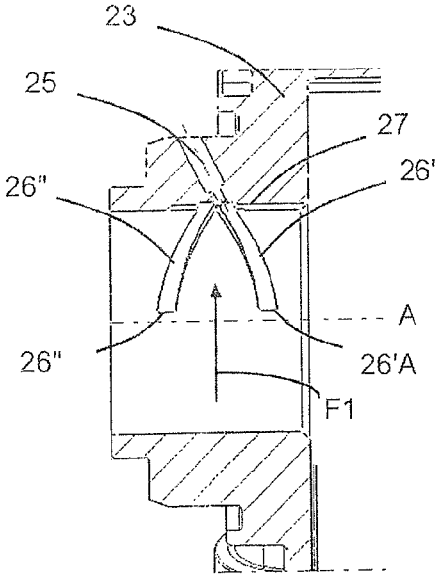

In the variant shown in FIGS. 4 and 5, multiple circumferential grooves, for instance two grooves, are provided in the rotor guide.

In FIG. 4, grooves 16', 16" still consist of arcs of circumference arranged in a plane orthogonal to the rotor axis and they are axially spaced apart along guide 13. Supply channel 15 ends into one of such grooves, for instance groove 16', whereas groove 16" (and the other grooves, if any) will receive oil from groove 16' through one or more axial grooves 17.

In FIG. 5, grooves 26', 26" are inclined relative to the rotor axis. More particularly, grooves 26', 26" are substantially tangent to each other at the end of supply channel 25 and diverge towards their ends 26'A, 26"A, with either a rectilinear or (as shown in the Figure) a curvilinear behaviour. Like in FIG. 4, channel 25 ends for instance into groove 26', whereas groove 26" (and the other grooves, if any) will be supplied with oil through one or more axial grooves 27. The solution shown in FIG. 5 is suitable for a counterclockwise rotation of the rotor (arrow F1). Indeed oil, after having lubricated guide 23, tends to remain trapped by the V-shaped junction formed by grooves 26', 26", and hence it is not dispersed out of guide 23, thereby further improving the lubrication. Beyond the end of channel 25, grooves 26', 26" may continue as separate grooves or join into a single groove.

Figure 6:
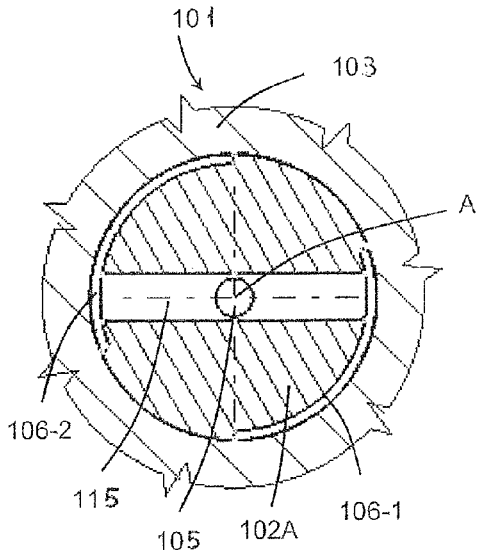
FIGS. 6 and 7 are views similar to FIGS. 1 and 2, relevant to an embodiment in which the circumferential groove is formed on the rotor.
Figure 7:
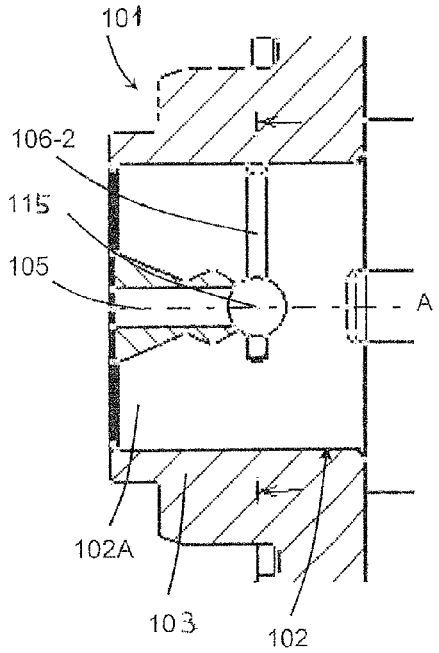
Figure 8:
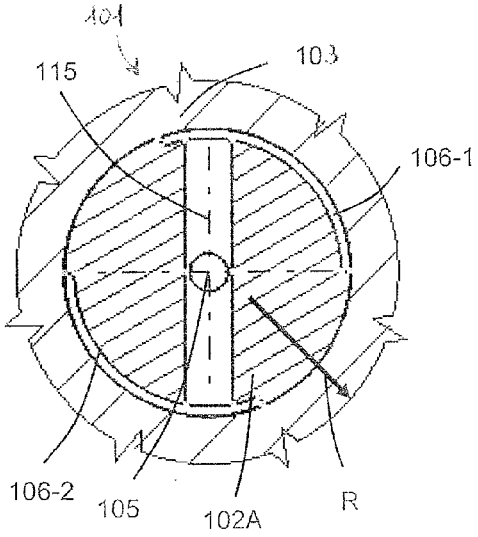
FIG. 8 is a view similar to FIG. 6, showing the position of the rotor during a discharge phase.

FIGS. 6 to 8 show a pump 101 where the circumferential groove is formed in support portion 102A of rotor 102, instead of being formed in the rotor guide 103. The example shown still refers to a pump with a single vane rotor, as shown in FIG. 3, hence to a pump having two discharge phases at each rotor revolution. In such a situation, the circumferential groove consists of two arcs 106-1, 106-2, symmetrical with respect to rotation axis A of the rotor and hence two interruptions are provided in the groove. The values given above for the angular extension of the groove refer in this case to the overall extension of both arcs 106-1, 106-2. Both arcs 106-1, 106-2 are formed in such a way that, at each discharge phase, one of the interruptions is located in the region where the resultant RF of the forces due to the discharge acts, as shown in FIG. 8. In the example illustrated, oil supply channel 105 directly ends into rotor 102 and supplies both arcs 106-1, 106-2 through a diametrical channel 115 internal to the rotor.

Figure 9:
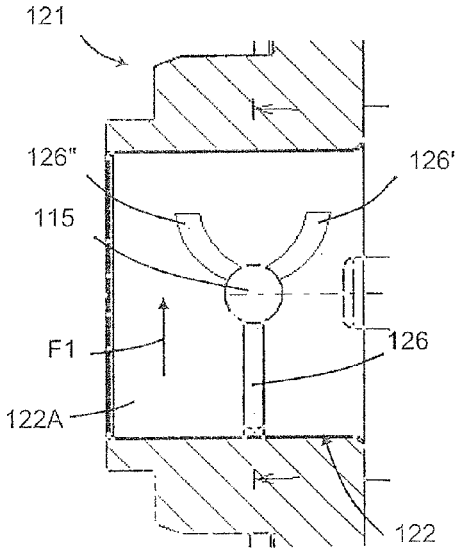
FIG. 9 is a view similar to FIG. 7, relevant to a variant in which the rotor has a pair of grooves like those shown in FIG. 5.

If the pump has a number of discharge phases different from two at each revolution of rotor 102, the circumferential groove formed on the rotor will include an arc and an interruption for each discharge phase, and the arcs and the interruptions will be so arranged that one interruption passes in the region opposite the discharge region at each discharge phase. In the variant shown in FIG. 9, a pump 121 is shown where each arc 126', 126" formed in support portion 122A of rotor 122 is branched, beyond internal supply channel 115, into a pair of inclined grooves 126', 126" similar to grooves 26', 26" shown in FIG. 5. As it is obvious for the skilled in the art, in order oil is collected at the vertex of the V-shaped junction, the latter is oriented in opposite direction with respect to the situation shown in FIG. 5, that is, it opens in the rotation direction, here again assumed to be the counterclockwise direction.

Figure 10:
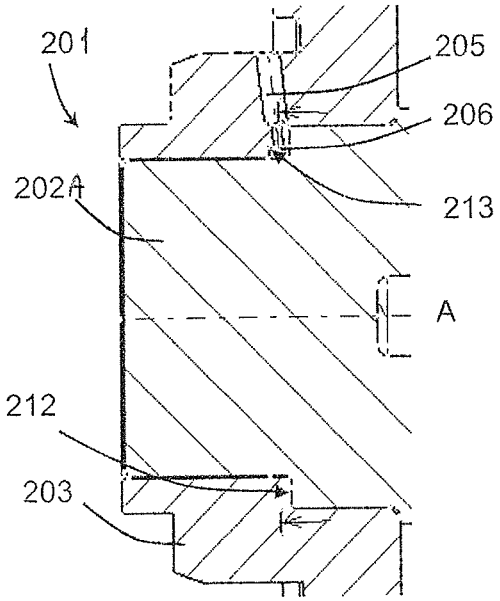
FIG. 10 is a view similar to FIG. 2, relevant to an embodiment in which the circumferential groove is formed by the intersection of the rotor and the rotor guide.

Lastly, FIG. 10 shows a pump 201 in which circumferential groove 206 is formed between facing surfaces of steps 212, 213 in the side surface of support portion 202A of rotor 202 and in the side surface of guide 203. Of course, according to the invention, step 213 will be formed only over a portion of the guide circumference.

Of course, a plurality of circumferential grooves may be provided also in the embodiment of FIG. 10.

It is clear that the above description has been given only by way of non-limiting example and that changes and modifications are possible without departing from the scope of the invention as defined in the appended claims.

In particular, even if a pump with a vane rotor has been referred to, the invention can be applied also to other types of rotary vacuum pumps. Moreover, is it is self-evident that the invention can be applied whatever to rotation direction of the rotor may be.

The invention claimed is:

1. A pump, which comprises a rotor where radial forces are applied, that is mounted for concentric rotation in a rotor guide and in which a circumferential groove is provided between facing side surfaces of the rotor and the rotor guide, said circumferential groove including an arc having an angular extension of less than 360° so as to form an interruption, wherein said pump is a rotary vacuum pump having only one discharge region, said circumferential groove:

comprises, in use, fluid received from a fluid supply duct, said fluid in said circumferential groove lubricates the rotor guide and creates a circumferential barrier sealing against air leaks between external and internal pump sides;

is formed in the side surface of the rotor guide or is defined by steps in side surfaces of the rotor guide; and wherein the circumferential groove and the interruption are arranged so that the interruption has an angular extension ranging from 60° to 180° and extends over a region of said side surface of the rotor guide which is opposite said only one discharge region of the pump and against which said radial forces push the rotor during a discharge phase, said interruption being arranged to create a hydrodynamic fluid bearing between said facing side surfaces of the rotor and the rotor guide at said region of said side surface of the rotor guide opposite said only one discharge region of the pump, over a whole axial extension of said facing side surfaces of the rotor and the rotor guide.

2. The pump as claimed in claim 1, wherein the circumferential groove has an angular extension ranging from about 150° to about 300°.

3. The pump as claimed in claim 2, wherein the circumferential groove is in communication with an axial groove for conveying the lubricating and sealing fluid towards the inner side of the pump.

4. The pump as claimed in claim 2, wherein the circumferential groove has an angular extension ranging from about 180° to about 220°.

5. The pump as claimed in claim 1, wherein the circumferential groove is in communication with an axial groove for conveying the lubricating and sealing fluid towards the inner side of the pump.

6. The pump as claimed in claim 5, wherein the circumferential groove lies on a plane perpendicular to a rotation axis of the rotor or on a plane inclined with respect to said rotation axis.

7. The pump as claimed in claim 6, wherein the circumferential groove branches at a fluid supply zone and forms a substantially V-shaped end section.

8. The pump as claimed in claim 6, wherein the circumferential groove comprises a plurality of circumferential grooves, which are distributed along an axial direction of the rotor and the rotor guide.

9. The pump as claimed in claim 5, wherein the circumferential groove branches at a fluid supply zone and forms a substantially V-shaped end section.

10. The pump as claimed in claim 5, wherein the circumferential groove comprises a plurality of circumferential grooves, which are distributed along an axial direction of the rotor and the rotor guide.

11. The pump as claimed in claim 1, wherein the circumferential groove lies on a plane perpendicular to a rotation axis of the rotor or on a plane inclined with respect to said rotation axis.

12. The pump as claimed in claim 11, wherein the circumferential groove branches at a fluid supply zone and forms a substantially V-shaped end section.

13. The pump as claimed in claim 11, wherein the circumferential groove comprises a plurality of circumferential grooves, which are distributed along an axial direction of the rotor and the rotor guide.

14. The pump as claimed in claim 1, wherein the circumferential groove branches at a fluid supply zone and forms a substantially V-shaped end section.

15. The pump as claimed in claim 1, wherein the circumferential groove comprises a plurality of circumferential grooves, which are distributed along an axial direction of the rotor and the rotor guide.

16. The pump as claimed in claim 1, wherein the circumferential barrier sealing is along an entire axial length of said side surface of the rotor guide where the interruption is arranged.

17. A method of lubricating a rotary vacuum pump, comprising a pump rotor, a rotor guide, a discharge region and a circumferential groove provided between facing side surfaces of the pump rotor and side surfaces of the rotor guide in which the same pump rotor concentrically rotates, said circumferential groove having an angular extension of less than 360° so as to form an interruption, said circumferential groove and said interruption being so arranged that the interruption has an angular extension ranging from 60° to 180° and extends over a region of said side surface of the rotor guide which is opposite said discharge region of the pump, wherein said method comprises the steps of:

introducing a lubricating and sealing fluid in said circumferential groove;

forming with the lubricating and sealing fluid introduced in said circumferential groove, a circumferential barrier sealing against air leaks between external and internal pump sides:

creating, by said interruption, a hydrodynamic fluid bearing between facing side surfaces of the rotor and the rotor guide at said region of said side surface of the rotor guide opposite and discharge region of the pump, over a whole axial extension of said facing side surfaces of the pump rotor and the rotor guide;

opposing, by said hydrodynamic fluid bearing, radial forces which push, during a discharge phase of the pump, the pump rotor against said region of said side surface of the rotor guide opposite said discharge region of the pump.

18. A pump, which comprises a rotor where radial forces are applied, that is mounted for concentric rotation in a rotor guide and in which at least two circumferential grooves are provided between facing side surfaces of the rotor and the rotor guide, said at least two circumferential grooves having an angular extension of less than 360° so as to form at least two interruptions, wherein said pump is a rotary vacuum pump having only one discharge region, said at least two circumferential grooves:

comprise, in use, fluid received from a fluid supply duct, said fluid in said at least two circumferential grooves lubricates the rotor guide and creates a circumferential barrier sealing against air leaks between external and internal pump sides;

are formed in the side surface of the rotor;

and wherein said at least two circumferential grooves and said at least two interruptions are arranged so that each of said at least two interruptions alternately faces, at each discharge phase of the pump, a region of said side surface of the rotor guide which is opposite said only one discharge region of the pump and against which said radial forces push the rotor during said discharge phase, said interruption being arranged to create, at each discharge phase of the pump, a hydrodynamic fluid bearing between said facing side surfaces of the rotor and the rotor guide at said region opposite said only one discharge region of the pump, over a whole axial extension of said side surfaces of the rotor and the rotor guide.

19. The pump as claimed in claim 18, wherein the circumferential groove branches at a fluid supply zone and forms a substantially V-shaped end section.

* * * * *